US010687146B2

(12) United States Patent
Grazian et al.

(10) Patent No.: US 10,687,146 B2
(45) Date of Patent: Jun. 16, 2020

(54) SPEAKER WITH FLEX CIRCUIT ACOUSTIC RADIATOR

(71) Applicant: Apple Inc., Cupertino, CA (US)

(72) Inventors: Anthony P. Grazian, Los Gatos, CA (US); Christopher Wilk, Mountain View, CA (US); Hongdan Tao, Sunnyvale, CA (US); Scott P Porter, Cupertino, CA (US); Michael Asfaw, Mountain View, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/224,584

(22) Filed: Dec. 18, 2018

(65) Prior Publication Data

US 2019/0149925 A1 May 16, 2019

Related U.S. Application Data

(62) Division of application No. 15/048,784, filed on Feb. 19, 2016, now Pat. No. 10,194,248.

(51) Int. Cl.
*H04R 9/02* (2006.01)
*H04R 9/06* (2006.01)
(Continued)

(52) U.S. Cl.
CPC ..... *H04R 9/06* (2013.01); *H04R 7/125* (2013.01); *H04R 7/18* (2013.01); *H04R 9/025* (2013.01);
(Continued)

(58) Field of Classification Search
CPC . H04R 7/18; H04R 7/125; H04R 9/06; H04R 9/025; H04R 9/045; H04R 29/001; H04R 31/003; H04R 2307/025
See application file for complete search history.

(56) References Cited

U.S. PATENT DOCUMENTS 6,654,476 B1 11/2003 Guenther
6,853,734 B2 2/2005 Sahyoun
(Continued)

FOREIGN PATENT DOCUMENTS

CN 101654524 2/2010
CN 202050538 U 11/2011
(Continued)

OTHER PUBLICATIONS

Australia First Examination Report for Australian Patent Appin No. 2017390082 dated Jan. 17, 2019; 5 Pages.
(Continued)

*Primary Examiner* — Brian Ensey
(74) *Attorney, Agent, or Firm* — Womble Bond Dickinson (US) LLP

(57) ABSTRACT

A speaker assembly including a frame and a magnet assembly positioned within the frame. The magnet assembly may include a magnet and a top plate. The assembly further including a sound radiating surface suspended over the magnet assembly. The sound radiating surface includes a flexible circuit. A suspension suspending the sound radiating surface over the magnet assembly is further provided. The suspension may be over molded to the sound radiating surface and the frame. A voice coil extends from a bottom side of the sound radiating surface and electrically connects to the flexible circuit.

19 Claims, 9 Drawing Sheets

(51) Int. Cl.

| | |
|---|---|
| ***H04R 31/00*** | (2006.01) |
| ***H04R 7/12*** | (2006.01) |
| ***H04R 7/18*** | (2006.01) |
| ***H04R 29/00*** | (2006.01) |
| *H04R 9/04* | (2006.01) |

(52) U.S. Cl.
CPC ..... *H04R 29/001* (2013.01); *H04R 31/003* (2013.01); *H04R 9/045* (2013.01); *H04R 2307/025* (2013.01)

(56) References Cited

U.S. PATENT DOCUMENTS

| | | | | |
|---|---|---|---|---|
| 7,006,651 | B2 | 2/2006 | Ueki | |
| 7,239,714 | B2 | 7/2007 | de Blol et al. | |
| 8,184,833 | B2 | 5/2012 | Demuynck | |
| 8,290,199 | B2 | 10/2012 | Pircaro | |
| 8,588,435 | B2 | 11/2013 | Bominaar-Silkens et al. | |
| 8,600,083 | B2 * | 12/2013 | Chiang | H04R 19/013 381/174 |
| 8,603,608 | B2 * | 12/2013 | Shin | C23C 16/26 428/172 |
| 8,776,367 | B2 * | 7/2014 | Lee | H04R 31/00 29/886 |
| 9,154,883 | B2 | 10/2015 | Wilk | |
| 9,271,084 | B2 | 2/2016 | Vieites et al. | |
| 9,288,582 | B2 | 3/2016 | Vieites et al. | |
| 9,621,994 | B1 | 4/2017 | Bongiovi et al. | |
| 9,832,557 | B2 | 11/2017 | Park et al. | |
| 2004/0086149 | A1 | 5/2004 | Johannsen et al. | |
| 2004/0228494 | A1 | 11/2004 | Smith | |
| 2005/0031140 | A1 | 2/2005 | Browning | |
| 2005/0057266 | A1 | 3/2005 | Morimoto | |
| 2005/0089187 | A1 * | 4/2005 | Turnmire | H04R 7/12 381/396 |
| 2006/0098838 | A1 | 5/2006 | Yoo | |
| 2006/0182292 | A1 | 8/2006 | Aarts | |
| 2008/0199028 | A1 * | 8/2008 | Takebe | H04R 7/125 381/190 |
| 2009/0074226 | A1 | 3/2009 | Eaton | |
| 2011/0200223 | A1 | 8/2011 | Hiwataski et al. | |
| 2011/0272208 | A1 * | 11/2011 | Shen | H04R 7/10 181/170 |
| 2012/0139367 | A1 | 6/2012 | Funaki | |
| 2012/0177211 | A1 | 7/2012 | Yamkovoy | |
| 2012/0177215 | A1 | 7/2012 | Bose et al. | |
| 2013/0016874 | A1 | 1/2013 | Huang | |
| 2013/0028459 | A1 | 1/2013 | Wang | |
| 2014/0016809 | A1 | 1/2014 | Van Doom | |
| 2015/0312660 | A1 * | 10/2015 | Lembacher | H04R 7/10 381/396 |
| 2016/0052246 | A1 * | 2/2016 | Egger | H04R 31/003 381/426 |
| 2017/0245057 | A1 | 8/2017 | Grazien et al. | |

FOREIGN PATENT DOCUMENTS

| | | |
|---|---|---|
| CN | 102970642 | 3/2013 |
| CN | 104640051 | 5/2015 |
| CN | 104918195 | 9/2015 |
| CN | 106162470 | 11/2016 |
| JP | 2010258495 | 11/2010 |
| WO | WO2011135291 | 11/2011 |
| WO | WO2012093058 | 7/2012 |
| WO | WO2016180299 | 11/2016 |

OTHER PUBLICATIONS

Utility Model Patentability Evaluation Report (UMPER) for Chinese Utility Model Patent No. ZL2017218841710, issued by the Chinese Patent Office dated Oct. 25, 2018.
Utility Model Patentability Evaluation Report (UMPER) for Chinese Utility Model ZL201721296769.8, issued by the Chinese Patent Office dated Aug. 22, 2018.
Notice of Allowance dated Apr. 11, 2018, U.S. Appl. No. 15/398,483.
Final Office Action dated Dec. 18, 2017, U.S. Appl. No. 15/398,483.
Chinese Notice of Allowance dated Jun. 21, 2018, CN Application No. 201721884171.0.
Notice of Allowance dated Jul. 6, 2017, U.S. Appl. No. 15/398,483.
Evaluation Report fir Utility Model Patent dated Oct. 18, 2017, Chinese Patent No. ZL2017201413617.
Chinese Notice of Allowance dated Mar. 30, 2018, CN Application No. 201721296769.8.
International Search Report and Written Opinion dated May 3, 2018, PCT Applicaiton No. PCT/US2017/069050.
Utility Model Patent Evaluation Report dated Oct. 25, 2018 for Related Chinese Patent Appln. ZL2017218841710 7 pages.
Evaluation Report and Review Opinions for Utility Model Patent dated Jan. 28, 2019 for Chinese Patent Application No. 201721884171.0 8 Pages.
Australia Notice of Acceptance dated May 14, 2019 for Australian Patent Appin No. 2017390082 3 Pages.
2nd office action for Japanese Patent Appln. No. 2018-536806 dated Nov. 1, 2019.
Korean Office Action dated Mar. 28, 2019 for related Korean Patent Application No. 10-2018-7020235 5 Pages.

* cited by examiner

SPEAKER WITH FLEX CIRCUIT ACOUSTIC RADIATOR

CROSS-REFERENCE TO RELATED APPLICATION

This application is a divisional application of co-pending U.S. patent application Ser. No. 15/048,784, filed on Feb. 19, 2016, which is incorporated herein by reference.

FIELD

This application relates generally to a speaker with an acoustic radiator made from a flexible circuit and, more specifically, to a speaker having an acoustic radiator made of a flexible circuit that is electrically connected to the speaker components. Other embodiments are also described and claimed.

BACKGROUND

In modern consumer electronics, audio capability is playing an increasingly larger role as improvements in digital audio signal processing and audio content delivery continue to happen. In this aspect, there is a wide range of consumer electronics devices that can benefit from improved audio performance. For instance, smart phones include, for example, electro-acoustic transducers such as speakerphone loudspeakers and earpiece receivers that can benefit from improved audio performance. Smart phones, however, do not have sufficient space to house much larger high fidelity sound output devices. This is also true for some portable personal computers such as laptop, notebook, and tablet computers, and, to a lesser extent, desktop personal computers with built-in speakers. Many of these devices use what are commonly referred to as "micro-speakers." Micro-speakers are a miniaturized version of a loudspeaker, which use a moving coil motor to drive sound output. The moving coil motor may include a diaphragm, voice coil and magnet assembly positioned within a frame. Due to height limitations, the diaphragm is typically suspended within the frame by a single plane suspension system. In addition, electrical connections to the voice coil typically consist of wires running from the voice coil to other stationary components. The wires may flex as the radiator vibrates, which in turn, can lead to wire breakage and reliability issues in the field.

SUMMARY

This disclosure is directed to a transducer, for example a moving-coil speaker (e.g., a micro-speaker) that is water resistant, has high acoustic sensitivity, low tactility and incorporates a capacitive sensing element used for displacement detection of the acoustic radiator within the transducer. More specifically, some features of the speaker include an acoustic radiator or sound radiating surface (SRS) made from a flexible circuit (also commonly referred to as a flexible printed circuit board) with an over molded surround. The flexible circuit (or SRS) may, in turn, be used to connect the voice coil to external wiring (e.g., wiring external to the flexible circuit) and electronic components within the speaker. An advantage of using the flexible circuit (e.g., via circuitry therein) to provide electrical connections between the voice coil and wiring to external components, as opposed to the voice coil wiring itself extending directly to external components, is that the voice coil and the external wiring can be made of different materials that can improve an overall performance and reliability of the transducer. For example, the voice coil may be made of a relatively low-tensile strength and low mass material such as a copper-clad aluminum coil so that an overall mass of the voice coil is reduced. The external wiring, on the other hand, may be made of another type of wire material, for example, a higher-tensile strength material, such as a silver-copper alloy, that will not mechanically fatigue as it moves with respect to the SRS. In addition, the flexible circuit may be formed (e.g., thermoformed) to have a geometry that increases a stiffness of the radiator (and improves acoustic high-frequency performance of the speaker). In addition, to accommodate the moving assembly, a specially designed magnetic circuit is used which can accommodate the shape of the acoustic radiator and welded wires with minimal impact in motor strength.

More specifically, one embodiment is directed to a speaker assembly (e.g., a micro-speaker assembly) including a frame, a magnet assembly, a sound radiating surface, a suspension and a voice coil. The magnet assembly is positioned within the frame and may include a magnet and a top plate. The sound radiating surface is suspended over the magnet assembly and is formed from, or may include, a flexible circuit. The suspension suspends the sound radiating surface over the magnet assembly and is over molded to the sound radiating surface and the frame. The voice coil extends from a bottom side of the sound radiating surface and is electrically connected to the flexible circuit that may be used to form the sound radiating surface. In some cases, the flexible circuit is thermoformed to have an out-of-plane feature (e.g., a dome shaped region) dimensioned to geometrically stiffen the sound radiating surface, which in turn improves the sound radiating properties of the sound radiating surface. In addition, the flexible circuit (and in turn the sound radiating surface) may include a number of material layers. At least one of the material layers may include a conductive material, for example, a metal trace, metal layer, metal plate, or the like. The conductive material may, for example, be copper. In some embodiments, the flexible circuit (used to form the SRS) may include a metal layer and at least three polymer layers. At least one of the three polymer layers may include a polyester such as polyethylene naphthalate (PEN) or polyimide (PI) or polyethylene terephthalate (PET). In some embodiments, the top plate of the magnet assembly has an open center. The over molded suspension may be made of silicone. In addition, in some embodiments, the voice coil may include a voice coil lead wire electrically connected to a conductive trace in the flexible circuit, and the conductive trace in the flexible circuit serves to electrically connect the voice coil lead wire to an external wire. In some cases, the voice coil lead wire and the external wire may be made of different materials. For example, voice coil lead wire may be made of a lower tensile-strength material than the external wire.

The over molded suspension may form a seal between the sound radiating surface and the frame, and the seal prevents water ingress past the sound radiating surface. The speaker assembly may also include a capacitive displacement sensor having a first stationary electrode coupled to a portion of the frame positioned above or below, or both above and below, the sound radiating surface, and a second dynamic electrode formed within the flexible circuit of the sound radiating surface.

In another embodiment, the speaker assembly includes a frame having a top frame member and a bottom frame member. The assembly further includes a magnet assembly coupled to the bottom frame member. The magnet assembly may include a magnet and a top plate and the top plate may have an open center region. In addition, a sound radiating surface is positioned over the magnet assembly. The sound radiating surface may be formed from, or otherwise include, a flexible circuit having an out-of-plane region (e.g., concave, convex or dome shaped region) that is aligned with the open center region of the top plate. A suspension suspending the sound radiating surface from the bottom frame member and over the magnet assembly is also provided. In addition, a voice coil extends from a bottom side of the sound radiating surface and is electrically connected to the flexible circuit of the sound radiating surface. Finally, the assembly includes a capacitive displacement sensor having a first electrode coupled to the top frame member over the sound radiating surface, and a second electrode coupled to the sound radiating surface.

In some embodiments, the out-of-plane region is a concave region of the sound radiating surface that bows out in a direction of the magnet assembly. In addition, the suspension may be over molded to the bottom frame member and the sound radiating surface. The suspension may fluidly seal the sound radiating surface to the bottom frame member. The second electrode may include a metal plate formed within the flexible circuit of the sound radiating surface.

In another embodiment, a speaker assembly diaphragm is provided. The diaphragm includes a first material layer including a polymer material, a second material layer including a conductive material and a third material layer including a polymer material. The second material layer is between the first material layer and the third material layer. The first material layer and the third material layer may include a polyimide or a polyester. In some cases, both the first material layer and the third material layer include a polyester. In still further embodiments, both the first material layer and the third material layer include a polyimide. In some embodiments, the first material layer or the third material layer include polyethylene naphthalate. The diaphragm may further be stiffened with a fourth material layer made of a polyester, and the second material layer is a conductive layer. The conductive material of the second material layer may be a metal. The conductive material of the second material layer may be copper or aluminum.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments are illustrated by way of example and not by way of limitation in the figures of the accompanying drawings in which like references indicate similar elements. It should be noted that references to "an" or "one" embodiment in this disclosure are not necessarily to the same embodiment, and they mean at least one.

DETAILED DESCRIPTION

In this section we shall explain several preferred embodiments of this invention with reference to the appended drawings. Whenever the shapes, relative positions and other aspects of the parts described in the embodiments are not clearly defined, the scope of the invention is not limited only to the parts shown, which are meant merely for the purpose of illustration. Also, while numerous details are set forth, it is understood that some embodiments of the invention may be practiced without these details. In other instances, well-known structures and techniques have not been shown in detail so as not to obscure the understanding of this description. The terms "over", "to", and "on" as used herein may refer to a relative position of one feature with respect to other features. One feature "over" or "on" another feature or bonded "to" another feature may be directly in contact with the other feature or may have one or more intervening layers. In addition, the use of relative terms throughout the description, such as "top", "above or "upper" and "bottom", "under" or "lower" may denote a relative position or direction. For example, a "top edge", "top end" or "top side" may be directed in a first axial direction and a "bottom edge", "bottom end" or "bottom side" may be directed in a second direction opposite to the first axial direction.

Figure 1:
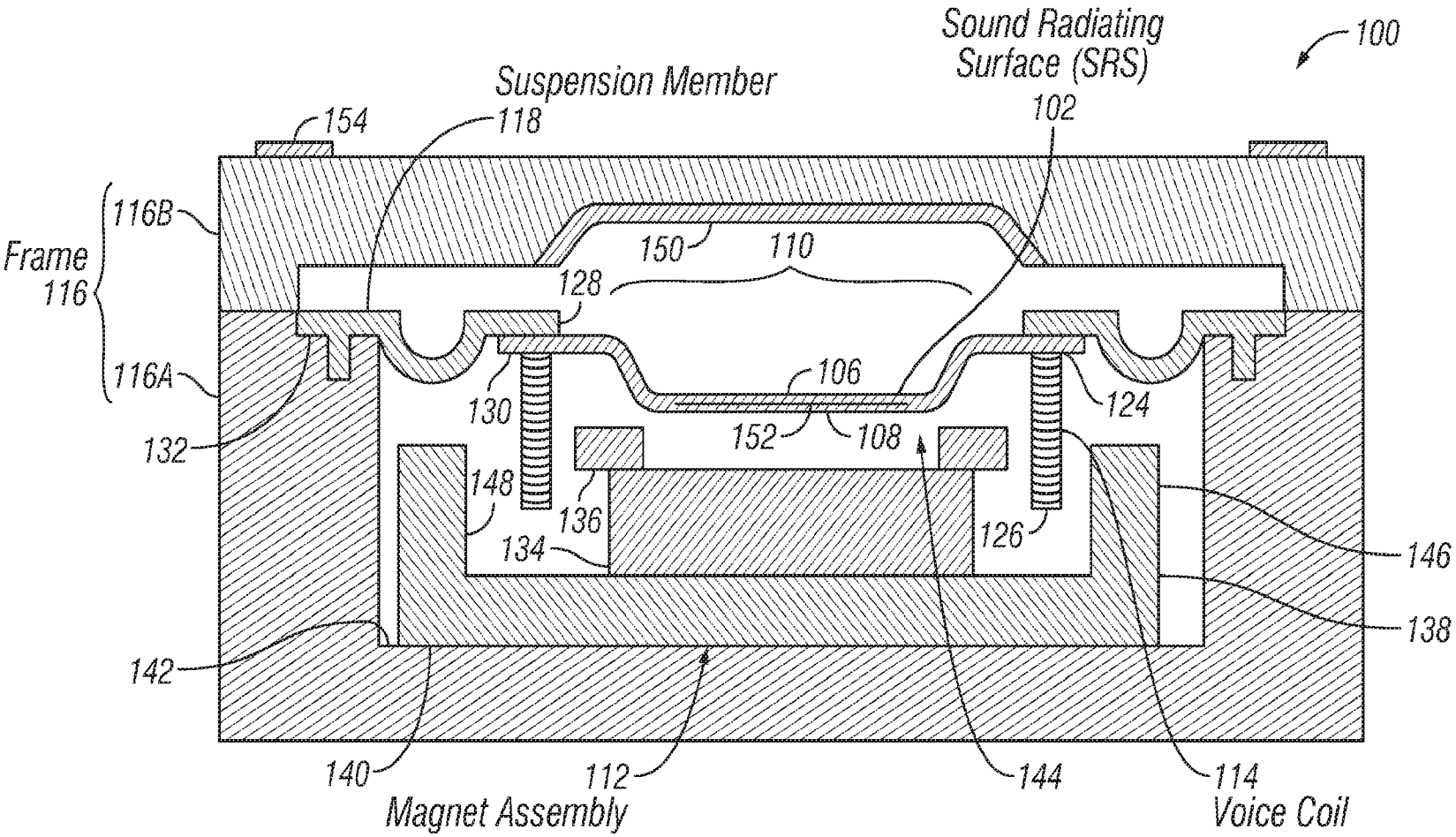
FIG. 1 illustrates a cross-sectional side view of one embodiment of a transducer.

FIG. 1 illustrates a cross-sectional side view of one embodiment of a transducer. Transducer 100 may be, for example, an electro-acoustic transducer that converts electrical signals into audible signals that can be output from a device within which transducer 100 is integrated. For example, transducer 100 may be a micro-speaker such as a speakerphone speaker or an earpiece receiver found within a smart phone, or other similar compact electronic device such as a laptop, notebook, or tablet computer. Transducer 100 may be enclosed within a housing or enclosure of the device within which it is integrated. In some embodiments, transducer 100 may be a 10 mm to 75 mm driver, or 10 mm to 20 mm driver (as measured along the diameter or longest length dimension), for example, a micro-speaker.

Transducer 100 may include a housing or frame 116, which encloses all of the components of transducer 100. Frame 116 may, in some cases, include a top frame member 116B and a bottom frame member 116A, between which a cavity for holding transducer components is formed. The top frame member 116B and the bottom frame member 116A may be welded together along their interfacing surfaces.

Transducer 100 may further include a sound radiating surface (SRS) 102. The SRS 102 may also be referred to herein as an acoustic radiator, a sound radiator or a diaphragm. SRS 102 may be any type of flexible membrane (which may include a number of material layers) capable of vibrating in response to an acoustic signal to produce acoustic or sound waves. In this aspect, SRS 102 may include a top face 106, which generates sound to be output to a user, and a bottom face 108, which is acoustically isolated from the top face 106, so that any acoustic or sound waves generated by the bottom face 108 do not interfere with those from the top face 106.

SRS 102 may have an out-of-plane region 110, for example, a concave dome or convex dome or other shaped region. In other words, the out-of-plane region 110 includes at least a portion which is in a different plane (e.g., a plane above or below) than the rest of SRS 102. The out-of-plane region 110 may be within a center of the SRS 102 and be curved, or otherwise bow out, in a direction of the underlying magnet assembly 112. The specific shape of the out-of-plane region 110 may be any shape that geometrically stiffens SRS 102 and improves a sound output from the SRS 102. For example, the out-of-plane region may be dimensioned to stiffen the SRS 102 and improve acoustic high-frequency performance of transducer 100. Still further, the out-of-plane region 110 may be dimensioned to stiffen the SRS 102 such that a breaking mode frequency of the SRS 102 is above a working range of transducer 100. For example, out-of-plane region 110 may be a dome shaped region that bows out in a downward direction (e.g., toward magnet assembly 112). Alternatively, out-of-plane region 110 may be a dome shaped region that bows out in an upward direction (e.g., toward top frame member 116A). The dome shaped region may, in some embodiments, include a flattened region (e.g., a disk shaped region) at its outermost portion, or be entirely curved. In addition, SRS 102 may include a stiffening material to materially stiffen SRS 102 in a manner that improves sound output, as will be discussed in more detail in reference to FIGS. 5A-5B.

In addition, SRS 102 may include conductive layers, tracks, traces, pads or other features so that electrical connections with other transducer components can be made through SRS 102. Representatively, in one embodiment, SRS 102 may include a number of material layers, at least one of which is a conductive layer. For example, SRS 102 may be made from a flexible circuit, having a number of preformed material layers, and thermoformed to have the desired SRS shape and size. For example, the flexible circuit may be heated, formed to the desired shape (e.g., a dome shape) using a mold and then cooled such that it retains the molded shape. The flexible circuit, or flex circuit or flexible printed circuit board (FPCB) as it is also commonly referred to, may be any flexible circuit having a number of material layers and circuitry formed within a flexible substrate whose shape may be changed upon application of an external force. This is in contrast to a "rigid" printed circuit board having two-dimensional and/or three-dimensional stability allowing no deformation, bending or an otherwise change in shape or profile of the structure upon application of an external force. It is further contemplated that in other embodiments, SRS 102 may, instead of being formed from a flexible circuit, be a diaphragm membrane having a flexible circuit mounted to an outer surface of the membrane. It should further be understood that any reference to a flexible circuit, flex circuit or FPCB herein is intended to include flexible circuits made by any technique, for example printing or any other techniques suitable for forming a flexible circuit which do not include a printing process. Further details regarding SRS 102 and the various material layers will be described in more detail in reference to FIG. 5A-FIG. 5B.

Transducer 100 may also include a voice coil 114 positioned along a bottom face 108 of SRS 102 (e.g., a face of SRS 102 facing magnet assembly 112). For example, in one embodiment, voice coil 114 includes an upper end 124 and a lower end 126. The upper end 124 may be directly attached to the bottom face 108 of SRS 102, such as by chemical bonding or the like. In another embodiment, voice coil 114 may formed by a wire wrapped around a former or bobbin and the former or bobbin is directly attached to the bottom face 108 of SRS 102. In one embodiment, voice coil 114 may have a similar profile and shape to that of SRS 102. For example, where SRS 102 has a square, rectangular, circular or elliptical shape, voice coil 114 may also have a similar shape. For example, voice coil 114 may have a substantially rectangular, square, circular or racetrack shape. In addition, voice coil 114 may be made of a relatively low tension wire material (e.g., copper clad aluminum) which is electrically connected to a conductive layer or trace within SRS 102, and the conductive layer or trace electrically connected to external wiring and components, as will be discussed in more detail in reference to FIG. 3-FIG. 4.

SRS 102, with voice coil 114 attached thereto, may be suspended within frame 116 by a suspension member 118, also referred to herein as a suspension or surround. For example, the suspension member 118 may have an inner edge 128 that is molded along an outer edge 130 of SRS 102. In addition, suspension member 118 may be over molded to the bottom frame member 116A along its outer edge 132. Alternatively, or in addition, the suspension member 118 may also be over molded to the top frame member 116B, or both the top and bottom frame members 116A, 116B along the outer edge 132. The suspension member 118 may be considered "molded" or "over molded" to the SRS 102 and/or the frame 116 in that suspension member 118 is formed (such as from liquid silicone) and chemically bonded to a surface of SRS 102 and/or frame 116 during an over molding process, for example, an injection molding process. In this aspect, a separate adhesive or bonding layer is not required to attach suspension member 118 to SRS 102 and/or frame 116. In addition, molding suspension member 118 to SRS 102 and frame 116 creates an air-tight and water-tight seal between SRS 102 and frame 116. This seal prevents acoustic cancellation and water ingress beyond (e.g., below) SRS 102 and therefore prevents any water, which may unintentionally enter transducer 100, from damaging the various electronic components and circuitry associated with transducer 100 (e.g., voice coil 114). In this aspect, transducer 100 has some tolerance to water and/or may be considered water resistant in that water will not disable the transducer 100. In one embodiment, the suspension member 118 may have what is considered a "rolled" configuration in that it has a concave or curved region between the inner edge 128 and outer edge 132 which allows for greater compliance in the z-direction (e.g., a direction perpendicular to the suspension member plane), and in turn, facilitates an up and down movement, also referred to as a vibration, of the SRS 102. The curved region may curve or bow in a direction of the magnet assembly 112. It should further be noted that although an over molded suspension member 118 is described, in other embodiments, where molding is not used, an adhesive or other bonding agent could be used to secure suspension member 118 to SRS 102 and/or frame 116.

Transducer 100 may further include a magnet assembly 112. Magnet assembly 112 may include a magnet 134 (e.g., a NdFeB magnet), with a top plate 136 and a yoke 138 for guiding a magnetic circuit generated by magnet 134. Magnet assembly 112, including magnet 134, top plate 136 and yoke 138, may be positioned below SRS 102, for example, between SRS 102 and bottom frame member 116A. For example, a bottom side 140 of magnet assembly 112 may be mounted to, or otherwise rest on such that it is in direct contact with, a top side 142 of bottom frame member 116A. A one-magnet embodiment is shown here, although multi-magnet motors are also contemplated.

In one embodiment, magnet 134 may be a center magnet positioned entirely within an open center of voice coil 114. In this aspect, magnet 134 may have a similar profile as voice coil 114, for example, a square, a rectangular, a circular, or elliptical shape. Top plate 136 may be specially designed to accommodate an out-of-plane region 110 (e.g., a concave or dome shaped region) of SRS 102. For example, top plate 136 may have a cut-out or opening 144 within its center that is aligned with the out-of-plane region 110 of SRS 102. In this aspect, the additional space created below the out-of-plane region 110 allows SRS 102 to move or vibrate up and down (e.g., pistonically) without contacting top plate 136. In this aspect, the opening 144 may have a similar size or area as the out-of-plane region 110. Yoke 138 may have a substantially "U" shaped profile such that its sidewalls 146, 148 form the gap with magnet 134, within which voice coil 114 is positioned.

Transducer 100 may further include a capacitive displacement sensor for sensing a displacement (e.g., vibration) of SRS 102. Representatively, in one embodiment, a top or first electrode 150 may be positioned along a side of the top frame member 116B facing SRS 102. The first electrode 150 may be positioned such that, in the vertical alignment, it overlaps with SRS 102. A second electrode 152 may be associated with SRS 102. For example, in one embodiment, the second electrode 152 is formed by a conductive layer or plate within the SRS 102 (e.g., within the flexible circuit). In other embodiments, the second electrode 152 may be a separate component that is attached to a surface of SRS 102, such as by an adhesive or chemical bonding. The first electrode 150 is in a fixed position while the second electrode 152 moves with SRS 102. The electrodes 150, 152 may either be flat or formed with out-of-plane features. Therefore, during operation, the movement of SRS 102 creates a change in the amount of capacitance between the first electrode 150 and the second electrode 152. This change in capacitance is sensed and translated into an electrical signal by, for example, an application-specific integrated circuit (ASIC) (not shown) electrically connected to the electrodes, for example, through a terminal 154 on frame 116 or elsewhere on transducer 100.

Figure 2:
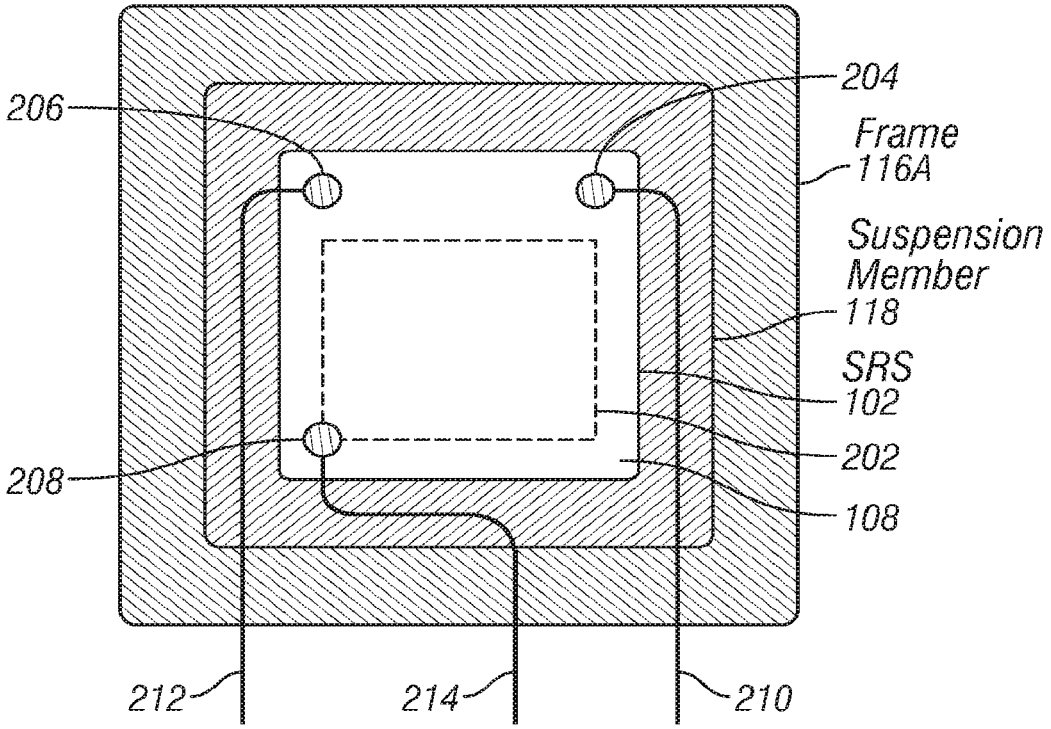
FIG. 2 illustrates a bottom plan view of the transducer of FIG. 1 with the voice coil and magnet assembly omitted.

FIG. 2 illustrates a bottom plan view of the transducer of FIG. 1 with the voice coil and magnet assembly omitted. From this view, it can be seen that SRS 102, which may be formed from a flexible circuit including traces or circuitry, may also include a conductive layer or plate 202 (as shown by dashed lines). The conductive layer or plate 202 may, for example, serve as the second electrode 152 formed within SRS 102 for capacitive sensing, as previously discussed in reference to FIG. 1.

Contact regions 204, 206 and 208 may further be formed, for example, within SRS 102 and exposed through the bottom side of SRS 102 to facilitate electrical connections with the circuitry and/or conductive plate 202 within SRS 102 (e.g., within the flexible circuit used to form SRS 102). For example, contact regions 204 and 206 may be contact pads (e.g., metal pads), which contact circuitry within SRS 102 and therefore can be used to electrically connect external wires 210, 212, respectively, to the circuitry or other external components electrically connected to contact regions 204 and 206 (e.g., to drive current through the voice coil 114 to operate the transducer 100). Alternatively, or in addition, contact regions 204, 206 and/or 208 may have openings within a layer of SRS 102, which expose the underlying conductive regions (e.g., plate 202 in the case of region 208) so that external wiring (e.g., wire 214) can be connected to them. In one embodiment, external wire 214 may be electrically connected to conductive plate 202 at contact region 208, for example, to facilitate capacitive displacement sensing as previously discussed. Representatively, external wires 210, 212 and 214 may be welded to contact regions 204, 206, 208, respectively, after the suspension member 118 is over molded to SRS 102. Each of external wires 210, 212, 214 may be high-tensile strength wires that will not mechanically fatigue with the movement of SRS 102. For example, wires 210, 212 and 214 may be silver copper alloy wires that have extra high-tension strength so that they will not break upon repeated movement of SRS 102. Likewise, tinsel wire may be used. Each of external wires 210, 212, 214 may further be electrically connected to external components such as an ASIC, or other electronic component associated with transducer 100, for example, by connecting them to the terminal 154 (or other terminals not shown) on frame 116 as previously discussed. For clarity, the three wires 210, 212, 214 are shown with a simple routing pattern.

Figure 3:
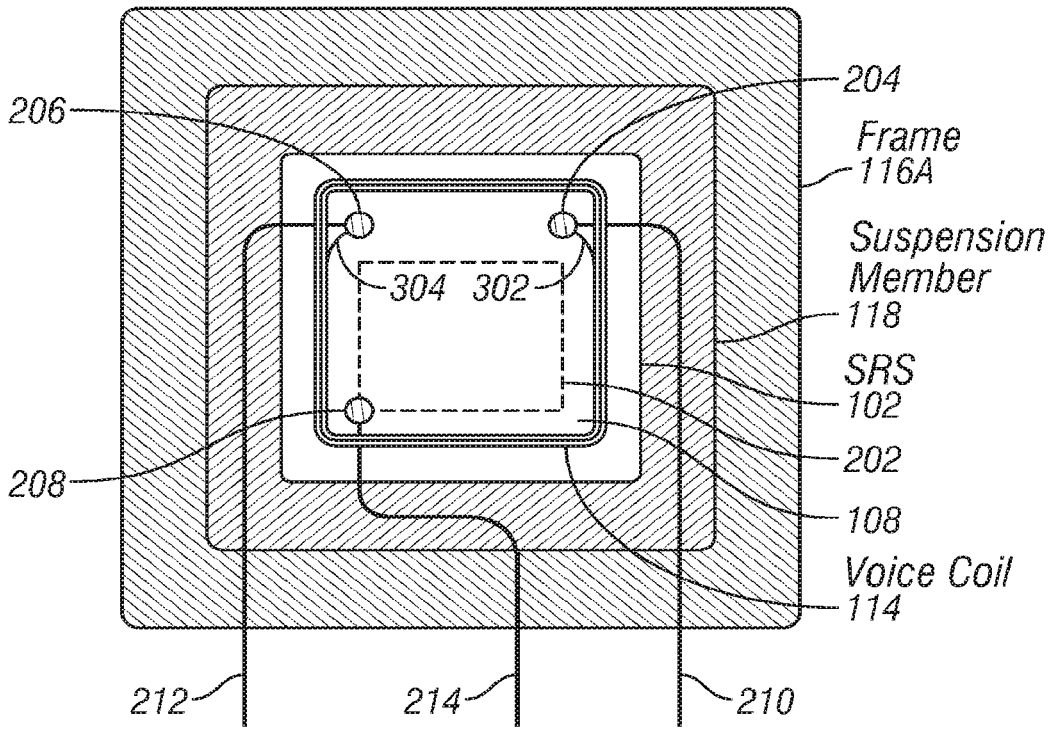
FIG. 3 illustrates a bottom plan view of the transducer of FIG. 2 with the voice coil included.

FIG. 3 illustrates a bottom plan view of the transducer of FIG. 2 with the voice coil included. From this view, it can be seen that once external wires 210, 212 and 214 are connected to contact regions 204, 206 and 208, respectively, voice coil 114 is positioned over the external wires 210, 212 and 214 and attached (e.g., glued) to the bottom face 108 of SRS 102. In other words, wires 210, 212 and 214 are sandwiched between SRS 102 and voice coil 114. It should be noted that if voice coil 114 is positioned around a bobbin, the bobbin may be attached to the bottom face 108 of SRS 102, instead of to the voice coil directly. The voice coil lead wires 302 and 304 are then welded to contact regions 204 and 206, respectively. In some embodiments, a surface finishing step is performed to facilitate attachment of lead wires 302, 304 to contact regions 204, 206, respectively. For example, a tin plating is applied to the contact regions 204, 206 (e.g., contact region pads) before welding on wires 302, 304.

Figure 4:
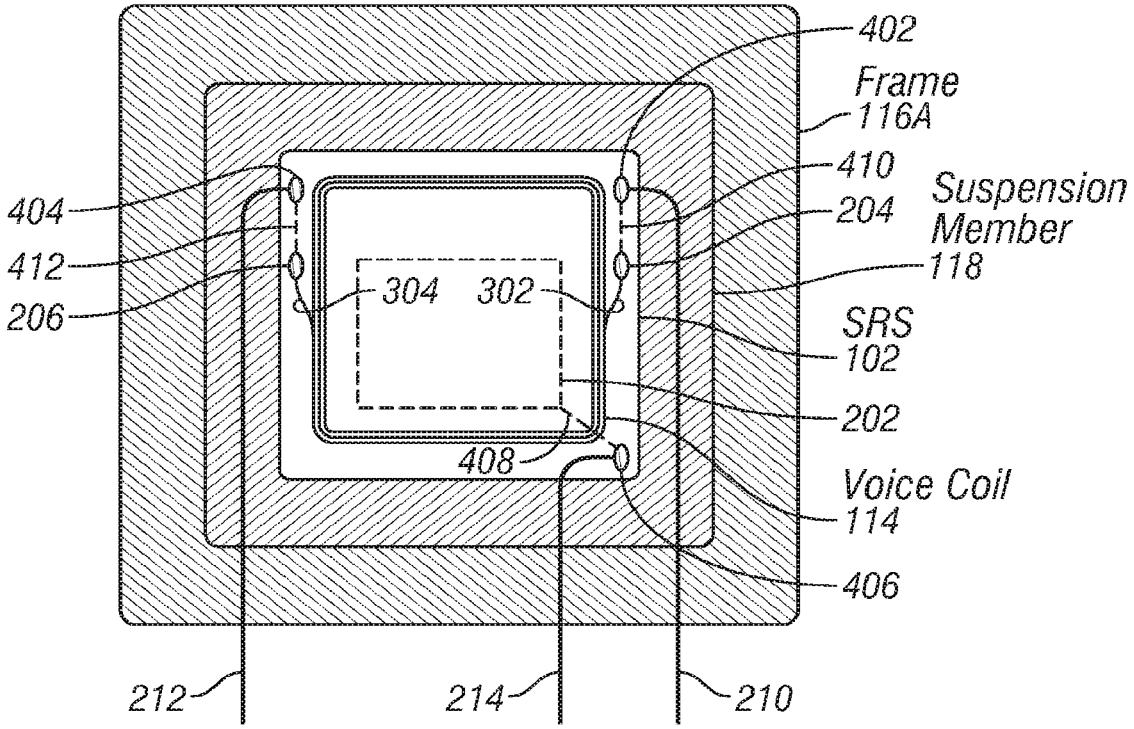
FIG. 4 illustrates a bottom plan view of another embodiment of the transducer of FIG. 1 with the magnet assembly omitted.

As previously discussed, voice coil lead wire 302 and external wire 210 are electrically connected at contact region 204, and contact region 204 may provide an electrical connection to SRS 102 (e.g., via a pad connected to a conductive layer such as traces or circuitry within a flexible circuit used to form SRS 102). Therefore, SRS 102 (e.g., via circuitry or traces with the flexible circuit) may be used to provide an electrical connection between voice coil 114 and external wire 210. Similarly, voice coil lead wire 304 and external wire 212 are electrically connected at contact region 206, and contact region 206 may provide an electrical connection to SRS 102 (e.g., via a pad connected to circuitry or traces within the flexible circuit used to form SRS 102). Therefore, SRS 102 (via the flexible circuit) may be used to provide an electrical connection between voice coil 114 and external wire 212. In other words, in one embodiment, the voice coil current is conducted by a conductive trace or layer of the flex circuit that constitutes the SRS 102. The SRS 102 formed from the flexible circuit as previously discussed therefore provides an advantage over an SRS not formed from a flexible circuit in that it can be used to electrically connect the voice coil 114 to external wires at contact regions, or route electrical connections between contact regions for the voice coil 114 and contact regions for the external wires, as shown in FIG. 4. The external wires 210, 212, in turn, may be used to electrically connect the voice coil lead wires 302, 304 to other circuitry or other electronic components associated with transducer 100 to help drive operation of the transducer 100.

In addition, it should be understood that because the voice coil lead wires 302, 304 are welded directly to the SRS 102 and then wires 210, 212 are used to electrically connect voice coil lead wires 302, 304 to, for example, another stationary member, there is minimal flexing of lead wires 302, 304 when the SRS 102 moves. As a result, the wire forming voice coil 114 can be made of a lower tension or tensile-strength material with less mass than that of wires 210, 212. This, in turn, reduces an overall mass of the SRS 102/voice coil 114 assembly. Reducing the mass of the SRS 102/voice coil 114 assembly may improve acoustic sensitivity and/or reduce unwanted transmitted forces (e.g., a user feeling the vibration of the SRS 102), which may occur in high powered transducers. For example, voice coil 114 can be made from a copper clad aluminum (CCA, 15-40% ratio) wire which reduces the mass of voice coil 114 and in turn the output of unwanted vibrational forces from transducer 100. Wires 210, 212, on the other hand, can be made of a higher tension or tensile strength material, for example, silver-copper alloy, as previously discussed. It should further be noted that external wire 214 may also be made of a similarly high tensile-strength material as wires 210, 212. It should further be understood that using a higher-tensile strength material for external wires 210, 212 and 214 (in comparison to that of voice coil 114) improves the reliability of the transducer 100 as previously discussed, while still achieving a low mass SRS 102/voice coil 114 assembly.

FIG. 4 illustrates a bottom plan view of another embodiment of the transducer of FIG. 1 with the magnet assembly omitted. The embodiment of FIG. 4 is substantially similar to that of FIG. 3, except in this case, each of wires 210, 212 and 214 and voice coil lead wires 302, 304 are electrically connected to different contact regions and the contact regions are moved outside of voice coil 114. It should be understood that moving the contact regions outside of the voice coil 114 reduces the number of cut-outs that may need to be formed in the top plate of the magnet assembly to accommodate electrical connections with the contact regions (see FIG. 6). Representatively, in this embodiment, SRS 102 includes five contact regions, namely, contact regions 204 and 206 positioned outside, or concentrically outward, to voice coil 114, similar to those previously discussed regarding FIG. 3, and additional contact regions 402, 404 and 406 also positioned outside, or concentrically outward, of voice coil 114, near an edge of SRS 102. Voice coil lead wires 302, 304 may be electrically connected (e.g., welded) to contact regions 204, 206, respectively, as previously discussed, while wires 210, 212 and 214 are electrically connected (e.g., welded) to contact regions 402, 404 and 406, respectively. In addition, a trace 408, or other similar electrical connector may be formed within SRS 102 (e.g., within the flexible circuit used to form SRS 102), between conductive plate 202 and contact region 406, to maintain an electrical connection between conductive plate 202 and wire 214. Similarly, there may be a trace 410 formed between contact regions 204 and 402 and a trace 412 formed between contact regions 206 and 404, for electrically connecting the regions with one another. Each of the contact regions 204, 206, 402, 404, 406 may include (or be) pads connected to traces or conductive regions within SRS 102, or be the internal conductive regions exposed through openings formed within the surface of SRS 102, so that voice coil lead wires 302, 304 and external wires 210, 212, 214 may be electrically connected to a respective one of the contact regions.

Figure 5A:
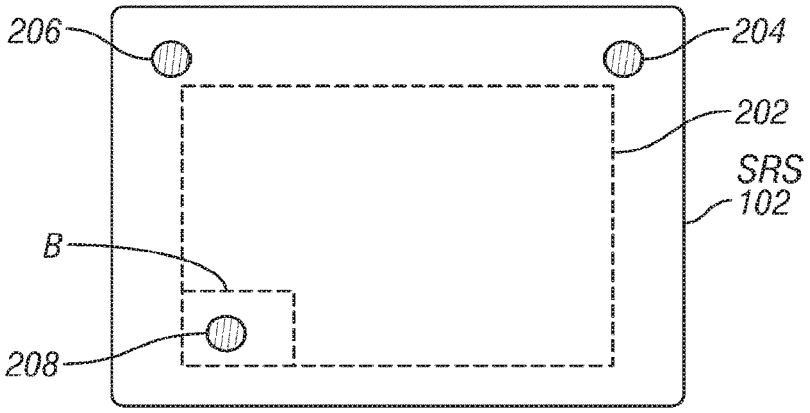
FIG. 5A illustrates a bottom plan view of the sound radiating surface of the transducer of FIG. 1.

FIG. 5A illustrates a bottom plan view of the SRS of the transducer of FIG. 1. SRS 102 is the same as SRS 102 described in reference to FIG. 2-FIG. 3, in that it includes conductive plate 202 and contact regions 204, 206 and 208. As previously discussed, SRS 102 may, for example, be formed from a flexible circuit including a number of material layers. The various material layers will now be described in reference to FIG. 5B, which is a cross-sectional side view of portion B (shown in dashed lines) in FIG. 5A.

Figure 5B:
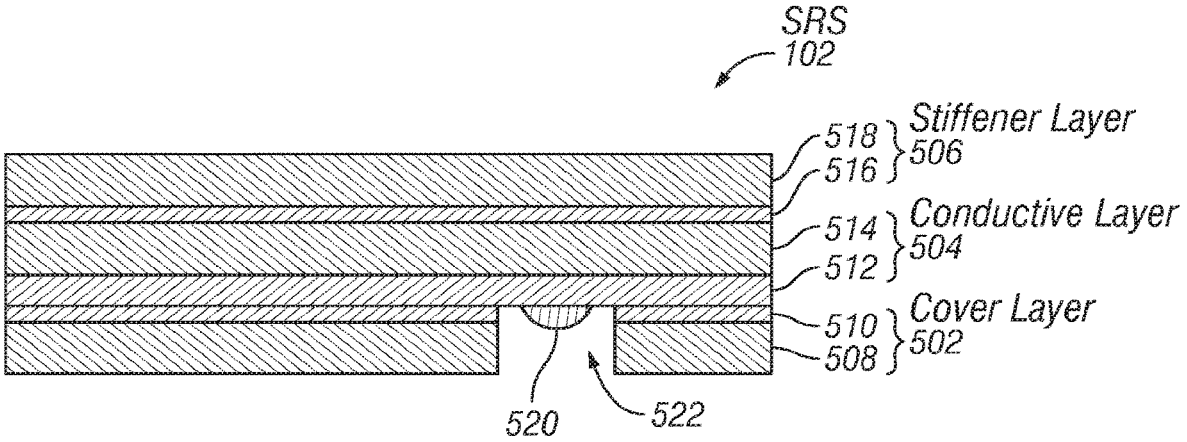
FIG. 5B illustrates a cross-sectional side view of a portion of the sound radiating surface of FIG. 5A.

In particular, it can be seen from FIG. 5B that SRS 102 includes a cover layer 502, a conductive layer 504 and a stiffener layer 506. One or more of cover layer 502, conductive layer 504 and/or stiffener layer 506 may be preformed layers within the flexible circuit, which as previously discussed, is thermoformed to achieve the desired SRS 102 configuration. The cover layer 502 may be made up of one or more material layers, which serve as a base layer for the overall stack up of material layers forming the SRS 102. The conductive layer 504 may be made up of one or more material layers, at least one of which is made of a conductive material, which provides for electrical connections with SRS 102. For example, the conductive layer may form the conductive plate 202 shown in FIG. 5A, as previously discussed. In addition, although not shown, the conductive layer 504 may include trace 410 that electrically connects contact region 204 to contact region 402, trace 412 that electrically connects contact region 206 to contact region 404, and trace 408 to electrically connects plate 202 to pad 406, as previously discussed in reference to FIG. 4. The stiffener layer 506 may be made of one or more layers of stiffening material that can provide material stiffness to SRS 102. In addition, although not shown, conductive traces, tracks, pads or other components for providing electrical connections through the various layers may also be provided.

Referring now to each layer in more detail, cover layer 502 may form an outer surface of SRS 102 and include a polymer layer 508. An adhesive layer 510 may optionally be provided for attaching the polymer layer 508 to conductive layer 504. The polymer layer 508 may, for example, be a layer of polyester or polyimide material. For example, the stiffener layer 506 may be made of a polyester such as polyethylene naphthalate (PEN). It should be noted that although not specifically designed for this purpose, the polymer layer 508 may also provide some material stiffness to the SRS 102. The adhesive layer 510 may be made of any type of adhesive material suitable for attaching one layer to another, for example, a glue or the like. The cover layer 502 may further include a cut-out or opening 522 to allow for a contact pad 520 (e.g., contact region 208) to electrically connect to conductive layer 504. In addition, although not shown in this view, the cover layer 502 may also have cutouts for contact regions 204 and 206. It is further noted that with respect to contact regions 204 and 206, any corresponding pad should not contact the metal layer 512 of conductive layer 504 (or at least the portion of metal layer 512 that makes up plate 202).

The conductive layer 504 may be stacked on top of the cover layer 502 and include a metal layer 512 and a polymer layer 514. The metal layer 512 is attached to the underlying polymer layer 508 of cover layer 502 by the previously discussed optional adhesive layer 510. The metal layer 512 may be formed of any type of metal material, for example copper or aluminum, a metal alloy, or other similar material having metal disposed therein (e.g., metal particles). For example, in one embodiment, the metal layer 512 is a copper plate, which forms plate 202 shown in FIG. 5A. The polymer layer 514 may include a layer of polyester or polyimide material. For example, the polymer layer 514 may be made of a polyimide such as PI. It should be noted that although not specifically designed for this purpose, the metal layer 512 and polymer layer 514 may also provide some material stiffness to the SRS 102. In addition, in some cases, the metal layer 512 is laminated with the polymer layer 514. For example, the metal layer 512 may be composed of a layer of copper laminated with PEN.

The stiffener layer 506 may be stacked on top of the conductive layer 504 and include a polymer layer 518 attached to the conductive layer 504 by an optional adhesive layer 516. The polymer layer 518 may be made of any polymer material suitable for providing mechanical stiffness to SRS 102. For example, the polymer layer 518 may be made of a polyester such as PEN. In addition, a thickness of polymer layer 518 may be specifically selected to further control its stiffening properties. For example, the polymer layer 518 may be anywhere from 5 to 100 microns, more specifically about 50 microns. The polymer layer 518 is directly attached to polymer layer 514 of conductive layer 504 with optional adhesive layer 516. It should further be noted that the entire stack shown in FIG. 5B (e.g., stiffener layer 506, conductive layer 504 and cover layer 502) are part of a flexible circuit that can optionally be thermoformed to be concave or convex as previously discussed.

It is further noted that in keeping with the desire to maintain a relatively low profile transducer, a combined thickness of all the material layers forming SRS 102 may be less than 120 microns, for example, less than 110 microns, or between 15 microns and 120 microns, or from about 100 microns and 120 microns. In this aspect, each of layers 508, 510, 512, 514, 516 and 518 may vary within a range of from about 5 microns to about 100 microns. For example, in some embodiments, the polymer layers 508, 514 and 518 may have a thickness of from about 8 microns to about 50 microns, for example, from about 12 microns to 40 microns, for example, from 12.5 microns to 30 microns, or from 15 microns to 20 microns. The metal layer 512, in some cases, may have a thickness of from about 8 microns to 50 microns, for example, from about 12 microns to 40 microns, or from about 12.5 microns to 30 microns, or from 15 microns to 20 microns. The optional adhesive layers 510, 516 may have a thickness of from about 10 microns to 50 microns, for example, from 12.5 microns to 30 microns, or from 15 microns to 20 microns.

Figure 6A:
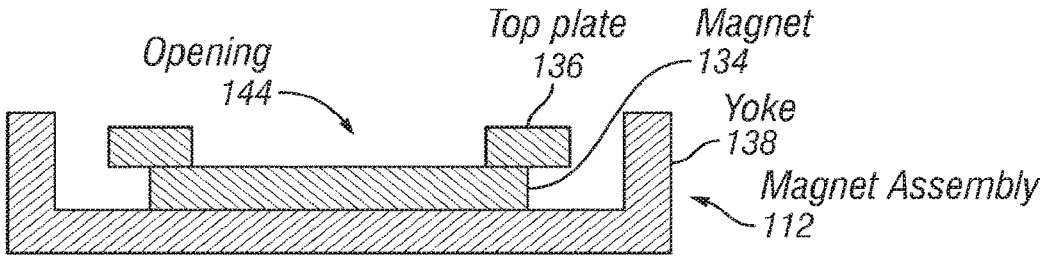
FIG. 6A illustrates a cross-sectional side view of the magnet assembly of the transducer of FIG. 1.
Figure 6B:
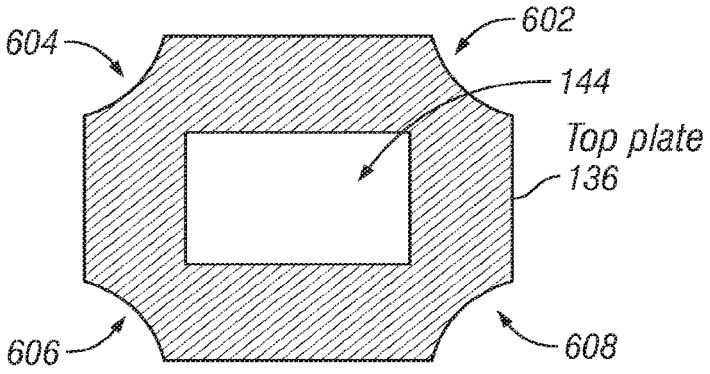
FIG. 6B illustrates a bottom plan view of the top plate of the magnet assembly of FIG. 6A.
Figure 6C:
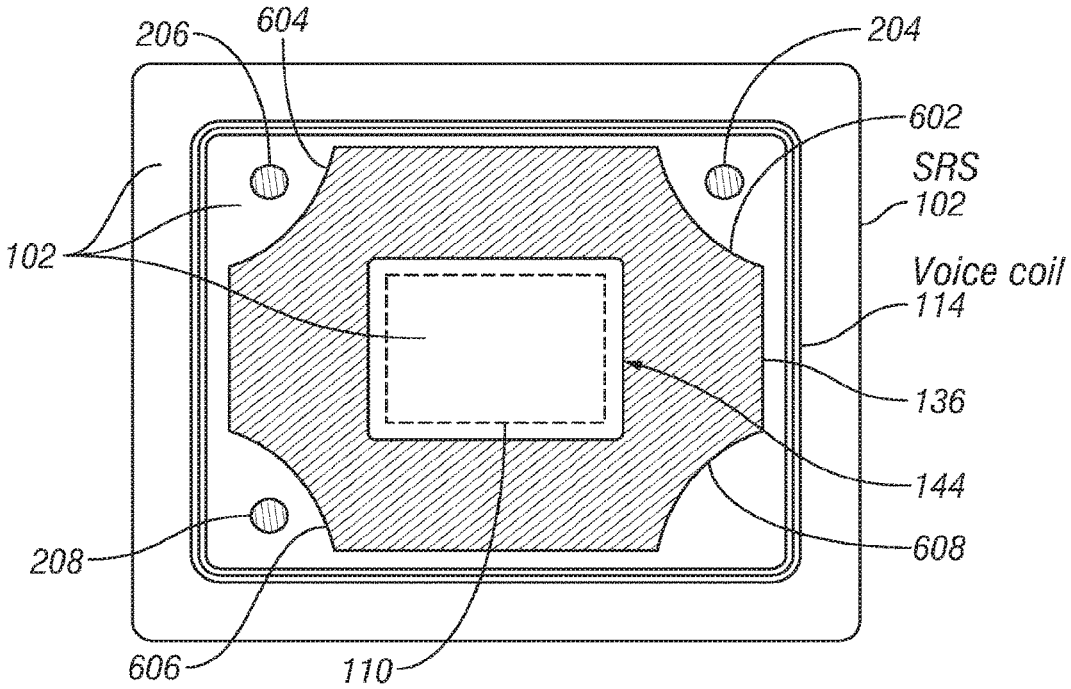
FIG. 6C illustrates a bottom plan view of the top plate of FIG. 6B assembled with the sound radiating surface and voice coil of FIG. 1.

FIG. 6A illustrates a cross-sectional side view of the magnet assembly of the transducer of FIG. 1. Magnet assembly 112 is the same as the magnet assembly described in reference to FIG. 1 in that it includes magnet 134, top plate 136 and yoke 138. In addition, top plate 136 includes opening 144 to accommodate the concave region of the overlying SRS. The opening 144, and other aspects of the top plate 136 can be seen more clearly from the bottom plan view of the top plate shown in FIG. 6B. In particular, from this view, it can be seen that opening 144 is within a center of top plate 136 and formed entirely through the plate. In addition, it can be seen that the corners of top plate 136 are cut-out such that top plate includes one or more corner cut-out regions 602, 604, 606 and 608. As can be seen from FIG. 6C, which is a bottom plan view of the top plate of FIG. 6B with the SRS 102 of FIG. 1 included, the corner cut-out regions 602, 604 and 606 provide openings or recessed regions within corners of top plate 136 that expose contact regions 204, 206 and 208 so that the external wires can be connected to contact regions 204, 206 and 208. The cut-out regions 602, 604 and 606 may be of any size and shape suitable for accommodating access to the contact regions 204, 206 and 208. Representatively, one or more of the cut-out regions 602, 604, 606 and 608 may form chamfered regions on the inside of a corner, on the outside of the corner, or both, of the top plate 136. The contour of a chamfered portion (that joins with, or is the transition between, the two sides of the top plate 136) may be entirely straight, or it may be curved. In addition, it can be seen that opening 144 has a similar profile to that the out-of-plane region 110 of SRS 102, for example, a square shaped profile, in this case. It should further be understood that while in FIG. 6B and FIG. 6C, top plate 136 is shown having four cut-out regions 602, 604, 606 and 608, fewer cut-out regions may be used depending upon the number of contact regions. For example, in one embodiment, cut-out region 608 may be omitted such that only three corners of top plate 136 include cut-out regions 602, 604 and 606.

Figure 7:
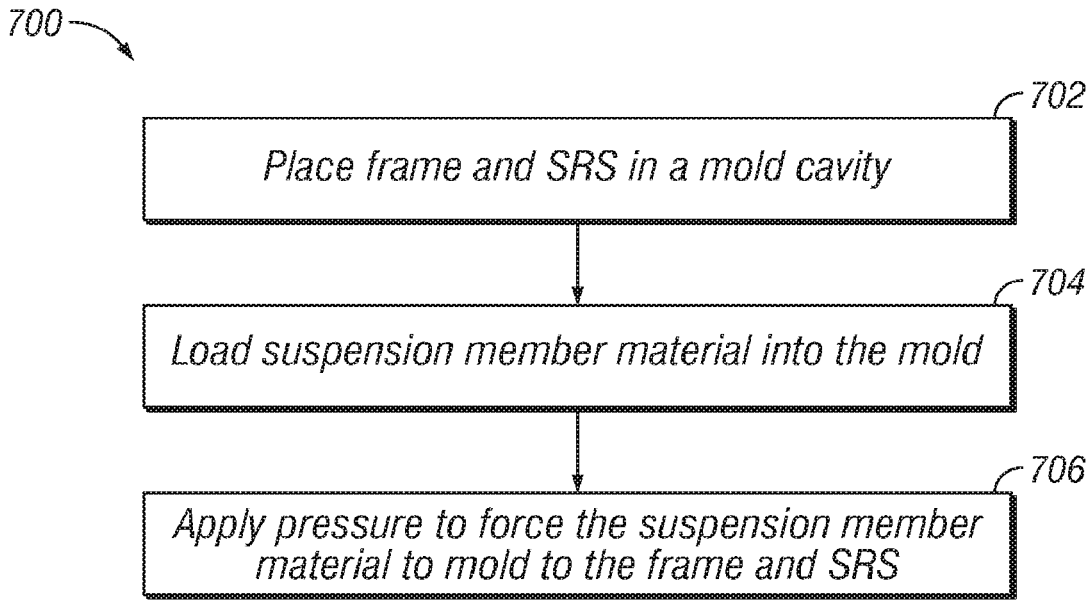
FIG. 7 illustrates a process flow of one embodiment for forming the suspension of FIG. 1.

FIG. 7 illustrates a process flow of one embodiment for forming the suspension member of FIG. 1. In particular, the over molding process 700 includes the process operation of placing the transducer frame (e.g., bottom frame member 116A) and the SRS (e.g., SRS 102) into a mold cavity (block 702). The mold cavity may be dimensioned to hold the frame and the SRS in the desired position, and have the desired suspension member shape. Next, the suspension member material may be loaded into the mold cavity such that it covers the outer edge of the SRS and inner surfaces of the frame (block 704). In some cases, the suspension member material is a silicone material that is melted prior to loading into the mold such that it is injected in liquid form. Once the material is loaded, a pressure is applied (such as by a mold top member) to force the suspension member material to be molded into the desired shape, and to the frame and SRS (block 706). The suspension member material is then solidified (such as by cooling) to form a suspension member (e.g., suspension member 118), which is over molded to the SRS and frame. The mold can then be opened and the frame and SRS, with the suspension member over molded thereto, removed for further assembly of the other transducer components thereto (e.g., voice coil, magnet assembly and wiring).

Figure 8:
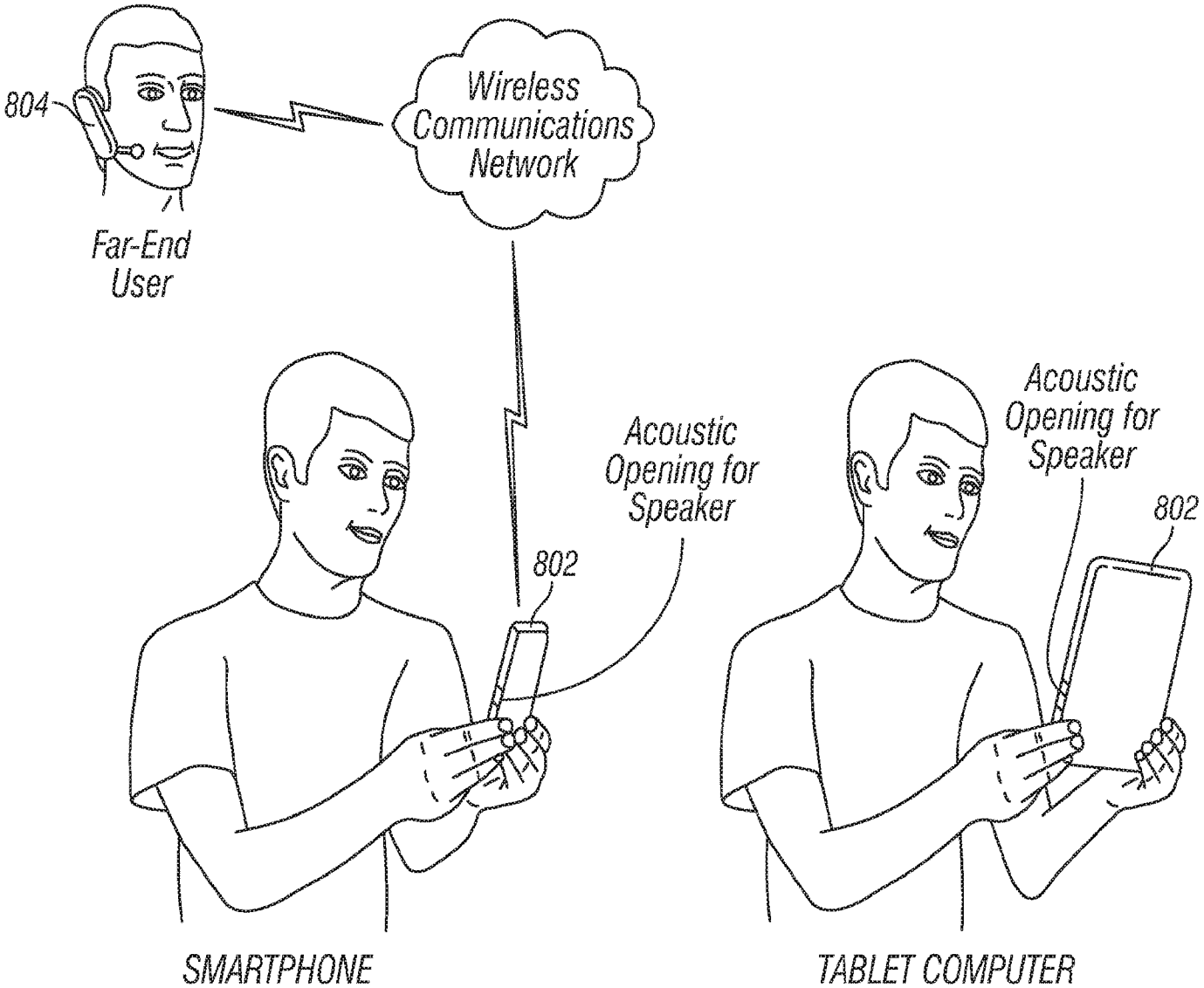
FIG. 8 illustrates one embodiment of a simplified schematic view of one embodiment of an electronic device in which one or more embodiments may be implemented.

FIG. 8 illustrates one embodiment of a simplified schematic view of one embodiment of an electronic device in which a speaker assembly, such as that described herein, may be implemented. As seen in FIG. 8, the speaker may be integrated within a consumer electronic device 802 such as a smart phone with which a user can conduct a call with a far-end user of a communications device 804 over a wireless communications network; in another example, the speaker may be integrated within the housing of a tablet computer. These are just two examples of where the speaker described herein may be used, it is contemplated, however, that the speaker may be used with any type of electronic device in which a transducer, for example, a loudspeaker or microphone, is desired, for example, a tablet computer, a desk top computing device or other display device.

Figure 9:
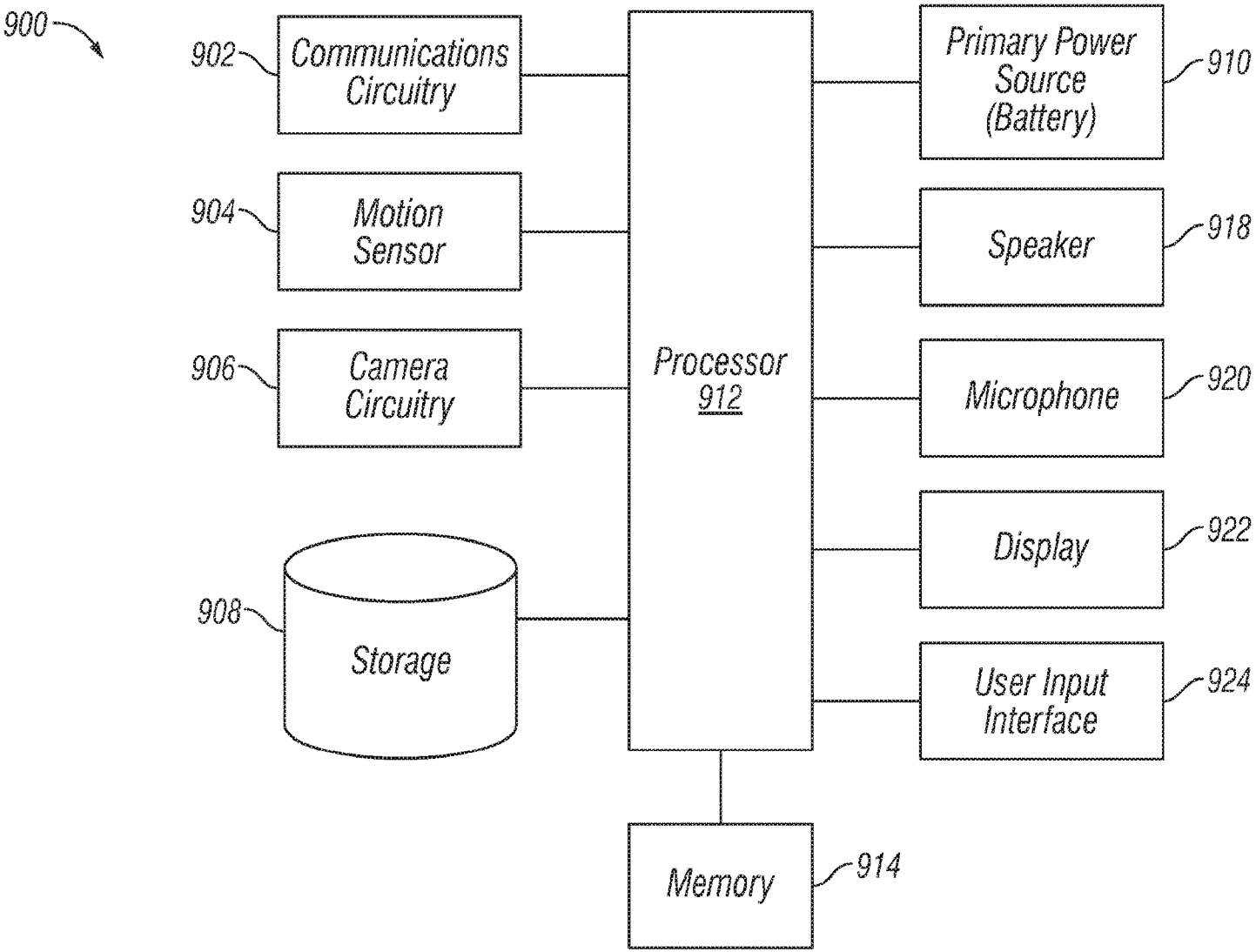
FIG. 9 illustrates a block diagram of some of the constituent components of an embodiment of an electronic device in which one or more embodiments may be implemented.

FIG. 9 illustrates a block diagram of some of the constituent components of an embodiment of an electronic device in which one or more embodiments may be implemented. Device 900 may be any one of several different types of consumer electronic devices. For example, the device 900 may be any transducer-equipped mobile device, such as a cellular phone, a smart phone, a media player, or a tablet-like portable computer.

In this aspect, electronic device 900 includes a processor 912 that interacts with camera circuitry 906, motion sensor 904, storage 908, memory 914, display 922, and user input interface 924. Main processor 912 may also interact with communications circuitry 902, primary power source 910, speaker 918 and microphone 920. Speaker 918 may be a microspeaker such as that described in reference to FIG. 1. The various components of the electronic device 900 may be digitally interconnected and used or managed by a software stack being executed by the processor 912. Many of the components shown or described here may be implemented as one or more dedicated hardware units and/or a programmed processor (software being executed by a processor, e.g., the processor 912).

The processor 912 controls the overall operation of the device 900 by performing some or all of the operations of one or more applications or operating system programs implemented on the device 900, by executing instructions for it (software code and data) that may be found in the storage 908. The processor 912 may, for example, drive the display 922 and receive user inputs through the user input interface 924 (which may be integrated with the display 922 as part of a single, touch sensitive display panel). In addition, processor 912 may send an audio signal to speaker 918 to facilitate operation of speaker 918.

Storage 908 provides a relatively large amount of "permanent" data storage, using nonvolatile solid state memory (e.g., flash storage) and/or a kinetic nonvolatile storage device (e.g., rotating magnetic disk drive). Storage 908 may include both local storage and storage space on a remote server. Storage 908 may store data as well as software components that control and manage, at a higher level, the different functions of the device 900.

In addition to storage 908, there may be memory 914, also referred to as main memory or program memory, which provides relatively fast access to stored code and data that is being executed by the processor 912. Memory 914 may include solid state random access memory (RAM), e.g., static RAM or dynamic RAM. There may be one or more processors, e.g., processor 912, that run or execute various software programs, modules, or sets of instructions (e.g., applications) that, while stored permanently in the storage 908, have been transferred to the memory 914 for execution, to perform the various functions described above.

The device 900 may include communications circuitry 902. Communications circuitry 902 may include components used for wired or wireless communications, such as two-way conversations and data transfers. For example, communications circuitry 902 may include RF communications circuitry that is coupled to an antenna, so that the user of the device 900 can place or receive a call through a wireless communications network. The RF communications circuitry may include a RF transceiver and a cellular baseband processor to enable the call through a cellular network. For example, communications circuitry 902 may include Wi-Fi communications circuitry so that the user of the device 900 may place or initiate a call using voice over Internet Protocol (VOIP) connection, transfer data through a wireless local area network.

The device may include a microphone 920. Microphone 920 may be an acoustic-to-electric transducer or sensor that converts sound in air into an electrical signal. The microphone circuitry may be electrically connected to processor 912 and power source 910 to facilitate the microphone operation (e.g., tilting).

The device 900 may include a motion sensor 904, also referred to as an inertial sensor, that may be used to detect movement of the device 900. The motion sensor 904 may include a position, orientation, or movement (POM) sensor, such as an accelerometer, a gyroscope, a light sensor, an infrared (IR) sensor, a proximity sensor, a capacitive proximity sensor, an acoustic sensor, a sonic or sonar sensor, a radar sensor, an image sensor, a video sensor, a global positioning (GPS) detector, an RF or acoustic doppler detector, a compass, a magnetometer, or other like sensor. For example, the motion sensor 904 may be a light sensor that detects movement or absence of movement of the device 900, by detecting the intensity of ambient light or a sudden change in the intensity of ambient light. The motion sensor 904 generates a signal based on at least one of a position, orientation, and movement of the device 900. The signal may include the character of the motion, such as acceleration, velocity, direction, directional change, duration, amplitude, frequency, or any other characterization of movement. The processor 912 receives the sensor signal and controls one or more operations of the device 900 based in part on the sensor signal.

The device 900 also includes camera circuitry 906 that implements the digital camera functionality of the device 900. One or more solid state image sensors are built into the device 900, and each may be located at a focal plane of an optical system that includes a respective lens. An optical image of a scene within the camera's field of view is formed on the image sensor, and the sensor responds by capturing the scene in the form of a digital image or picture consisting of pixels that may then be stored in storage 908. The camera circuitry 906 may also be used to capture video images of a scene.

Device 900 also includes primary power source 910, such as a built in battery, as a primary power supply.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. For example, the various speaker components described herein (e.g., diaphragm with flexible PCB, over molded suspension member, magnet top member with an opening, capacitive sensor, etc.) could be used in an acoustic-to-electric transducer or other sensor that converts sound in air into an electrical signal, such as for example, a microphone. The description is thus to be regarded as illustrative instead of limiting.

What is claimed is:

1. A speaker assembly diaphragm comprising:

a first material layer comprising a polymer material;

a second material layer comprising a conductive material laminated with polyethylene naphthalate; and a third material layer comprising a polymer material, and wherein the second material layer is between the first material layer and the third material layer, and the conductive material of the second material layer occupies less than an entire area of the first material layer or the second material layer.

2. The speaker assembly diaphragm of claim 1 wherein the first material layer and the third material layer comprise a polyimide or a polyester.

3. The speaker assembly diaphragm of claim 1 wherein both the first material layer and the third material layer comprise a polyimide.

4. The speaker assembly diaphragm of claim 1 wherein one of the first material layer or the third material layer comprises polyethylene naphthalate.

5. The speaker assembly diaphragm of claim 1 wherein the conductive material of the second material layer comprises a metal, and the first material layer or the third material layer comprises an opening to the metal.

6. The speaker assembly diaphragm of claim 1 wherein the conductive material of the second material layer comprises copper or aluminum.

7. A speaker assembly diaphragm comprising:

a cover layer comprising a polymer material;

a conductive layer coupled to the cover layer, the conductive layer comprising a conductive material and a polymer material; and a stiffener layer coupled to a side of the conductive layer opposite the cover layer, the stiffener layer comprising a polymer material, wherein the cover layer and the stiffener layer form an out-of-plane region and the conductive material is confined to the out-of-plane region.

8. The speaker assembly diaphragm of claim 7 wherein the cover layer and the stiffener layer form outer surfaces of a diaphragm.

9. The speaker assembly diaphragm of claim 7 wherein the polymer material of the cover layer comprises polyethylene naphthalate.

10. The speaker assembly diaphragm of claim 7 wherein the cover layer comprises an opening to the conductive layer.

11. The speaker assembly diaphragm of claim 7 wherein the conductive material of the conductive layer comprises a metal plate.

12. The speaker assembly diaphragm of claim 11 wherein the metal plate comprises copper.

13. The speaker assembly diaphragm of claim 7 wherein the conductive material of the conductive layer is laminated with the polymer material.

14. The speaker assembly diaphragm of claim 7 wherein the conductive layer comprises a conductive material comprising copper and a polymer material comprising a polyimide.

15. The speaker assembly diaphragm of claim 7 wherein the polymer material of the stiffener layer comprises a polyester.

16. The speaker assembly diaphragm of claim 15 wherein the polyester comprises polyethylene naphthalate.

17. The speaker assembly diaphragm of claim 7 further comprising a first adhesive layer that attaches the cover layer to the polymer material of the conductive layer and a second adhesive layer that attaches the conductive material of the conductive layer to the stiffener layer.

18. The speaker assembly diaphragm of claim 7 wherein the stiffener layer comprises a thickness of from 5 microns to 100 microns.

19. The speaker assembly diaphragm of claim 7 wherein an overall thickness of the cover layer, the conductive layer and the stiffener layer is less than 120 microns.

* * * * *